US007810661B2

(12) United States Patent
Murphy

(10) Patent No.: US 7,810,661 B2
(45) Date of Patent: Oct. 12, 2010

(54) BABY FORMULA TRAVEL BOTTLE

(76) Inventor: Amy Murphy, 11457 E. Bella Vista Dr., Scottsdale, AZ (US) 85259

( * ) Notice: Subject to any disclaimer, the term of this patent is extended or adjusted under 35 U.S.C. 154(b) by 228 days.

(21) Appl. No.: 11/901,556

(22) Filed: Sep. 18, 2007

(65) Prior Publication Data

US 2008/0156763 A1 Jul. 3, 2008

Related U.S. Application Data

(60) Provisional application No. 60/882,313, filed on Dec. 28, 2006.

(51) Int. Cl.
*A61J 9/00* (2006.01)

(52) U.S. Cl. ..... 215/11.1; 215/DIG. 8; 206/219; 206/221

(58) Field of Classification Search ..... 215/11.1, 215/DIG. 8; 206/219, 221
See application file for complete search history.

(56) References Cited

U.S. PATENT DOCUMENTS 2,331,426 A * 10/1943 Scheemaeker ..... 210/515
2,773,591 A * 12/1956 Jensen ..... 206/220
2,786,769 A * 3/1957 Greenspan ..... 426/117
3,070,094 A * 12/1962 Sarnoff et al. ..... 604/89
3,321,097 A * 5/1967 Solowey ..... 206/221
3,537,605 A * 11/1970 Solowey ..... 206/222
3,951,387 A * 4/1976 Warden et al. ..... 366/197
5,275,298 A 1/1994 Holley, Jr. et al.
5,388,690 A * 2/1995 Mutterle et al. ..... 206/222
5,419,445 A 5/1995 Kaesemeyer
5,634,714 A 6/1997 Guild
5,692,644 A * 12/1997 Gueret ..... 222/80
5,772,017 A * 6/1998 Kang ..... 206/222
5,794,802 A 8/1998 Caola
6,068,396 A * 5/2000 Baudin ..... 366/130
6,305,576 B1 * 10/2001 Leoncavallo ..... 222/83.5
6,705,462 B2 * 3/2004 Kasuya ..... 206/222
2005/0263414 A1 * 12/2005 Harilela et al. ..... 206/221
2006/0185990 A1 * 8/2006 Rybar et al. ..... 206/219
2007/0017890 A1 * 1/2007 Al-Jadh ..... 215/11.1

* cited by examiner

*Primary Examiner*—Sue A Weaver
(74) *Attorney, Agent, or Firm*—James Ray & Assoc

(57) ABSTRACT

A baby-bottle apparatus for holding dry feeding formula separate from water in the bottle prior to in-situ mixing at feeding time combines a bottle, open and threaded at both ends, a powder chamber with a sealable, removable lid, and a piston-like pusher for releasing the lid and mixing the powder and water.

2 Claims, 5 Drawing Sheets

BABY FORMULA TRAVEL BOTTLE

CROSS REFERENCE TO RELATED APPLICATION

This patent application is related to and claims priority from U.S. Provisional Patent Application Ser. No. 60/882,313 filed Dec. 28, 2006.

FIELD OF THE INVENTION

The present invention relates, in general, to baby formula bottles and, more particularly, this invention relates to rapid and mess-free preparation of a ready-to-drink baby bottle in travel situations.

BACKGROUND OF THE INVENTION

Prior to the conception and development of the present invention, powder baby formula is typically measured in proper ratio to the amount of water in the bottle and then immediately added to the water and mixed just minutes prior to consumption. This approach presents no difficulty at home, but it does impose an inconvenience to the parents or caregivers while traveling. In fact, use of liquid formulas is more prevalent at home. Infants require frequent feeding and liquid formula bottles, premixed powder formula or milk require refrigeration to prevent spoilage, and heating is required prior to consumption. While the refrigeration and heating can be avoided by blending a powder and water just prior to consumption, this poses an inconvenience and potentially messy situation while traveling.

A key consideration for a convenient travel baby formula bottle not needing refrigeration is keeping the powder dry and separate from the water, but still in one container. Numerous, sometimes elaborate, devices have been disclosed for storing a formula powder within a bottle until just prior to consumption, with provisions for rapidly combining and mixing the liquid and powder without opening the bottle. Some represent a whole new bottle design while others are made to fit into a standard bottle arrangement.

For example, in U.S. Pat. No. 5,419,445, Kaesemeyer teaches the design of holding the formula powder in a cartridge inside a baby bottle with the water stored in the bottle below.

In U.S. Pat. No. 5,794,802, Caola teaches a reusable insert designed for standard baby bottles to keep the formula powder and water separate until a push rod forces a chamber seal into the water portion of the bottle. Activation in this case involves the unsanitary act of pushing on the nipple.

In U.S. Pat. No. 5,634,714 to Guild, a long-stemmed disk is dislodged and falls into the liquid allowing the powder to mix with the water.

One common and significant disadvantage of these three examples and others is that a portion of the sealing mechanism is pushed into the lower water compartment at the time of mixing, and it must be retrieved and reassembled later.

In U.S. Pat. No. 5,275,298, Holley et al teach a container and mixing apparatus for attaching to the top of a baby bottle with a nipple connected atop it. A hollow ball seal device is the key component, and it includes a cam follower, a pin, a sealing surface, and defines an opening. The construction and operation of the hollow ball seal appear to be somewhat complex. Including the Holley device, all of the aforementioned add the powder from above. Thus, it appears that there has been a need for a moderately-priced convenience device that avoids drawbacks of existing designs. Desirable features are being simple to use, but also easy to disassemble, clean, and reassemble.

SUMMARY OF THE INVENTION

A baby-bottle apparatus for holding dry feeding formula separate from water in the bottle prior to in-situ mixing at feeding time combines a bottle, open and threaded at both ends, a powder chamber with a sealable, removable lid, and a piston-like pusher for releasing the lid by pushing on the bottom and then mixing the powder and water.

In one alternative embodiment, the lid is lifted off a gasket by pushing a spring-loaded button assembly. This variation can be mounted on the top or the bottom of a bottle. A third embodiment, somewhat like the first, is also disclosed. In this case, the bottom is permanently sealed except for an orifice through which the push rod passes, and the rod and orifice are sealed by a tight-fitting bushing.

The present invention provides a convenient and economical device for storing and subsequently mixing a pre-measured amount of baby formula powder with water in a feeding bottle. It is especially convenient for times when traveling with an infant and refrigeration is not available.

OBJECTS OF THE INVENTION

It is, therefore, one of the primary objects of the present invention to provide a convenient and economical device that will simplify transportation and eventual mixing of powdered infant formula quickly and easily with water just prior to consumption.

An additional object of this invention is to provide an infant bottle attachment that is easy to clean and reassemble.

Still another object of the present invention is to provide a travel infant bottle system that is easy to load and simple to use.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
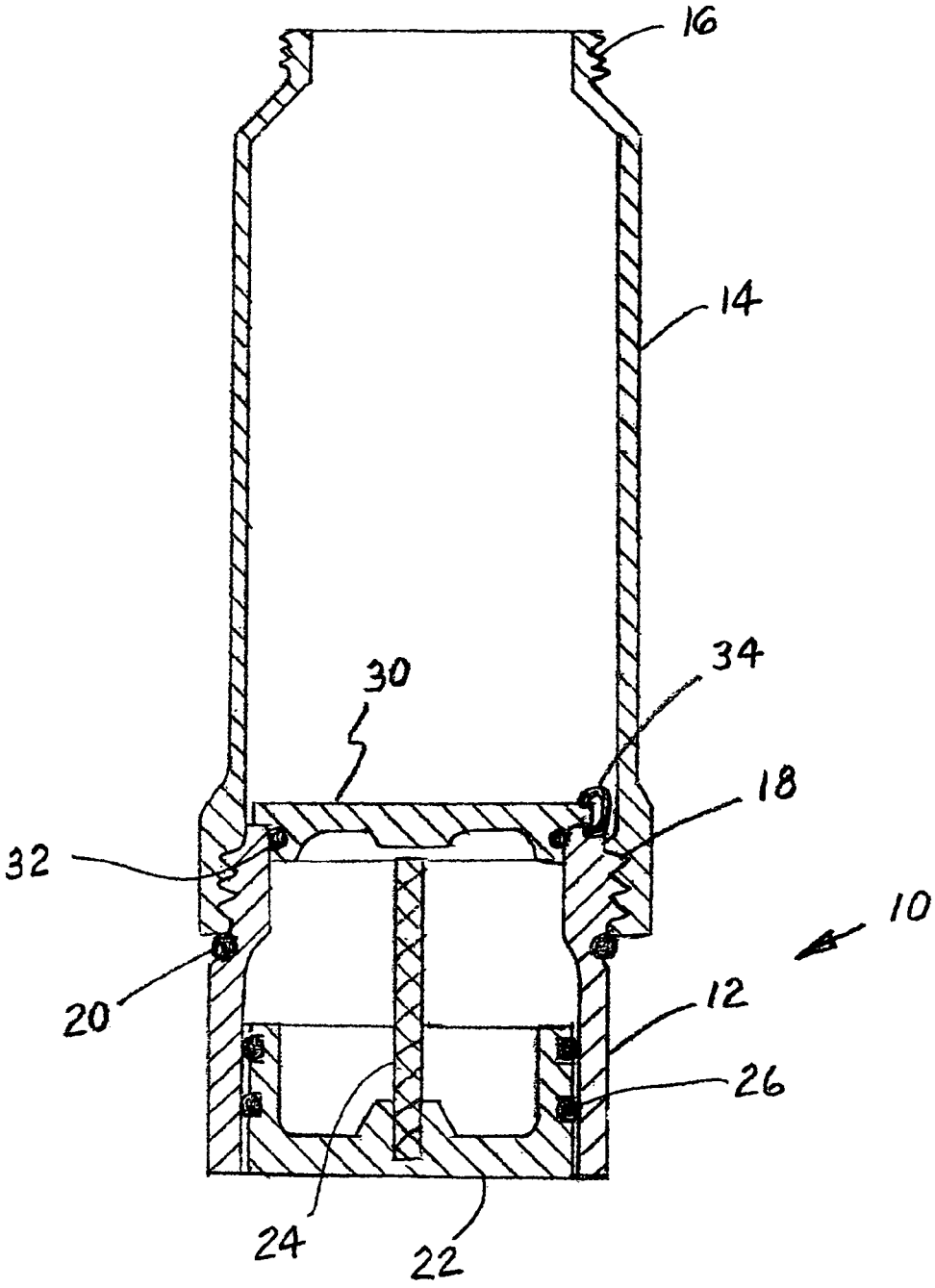
FIG. 1 is a sectional elevation view of an infant feeding bottle unit with the present invention attached to the bottom of the bottle.

DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Referring initially to FIG. 1, a bottle with formula device 10 is shown with formula holding chamber 12 screwed into the bottom of a matching baby bottle 14 above. The bottle water compartment 14 has top external threads 16 mating to a standard nipple assembly, and internal bottom threads 18. The formula chamber 12 and the water compartment 14 are both open at both ends. The upper outer end of the formula chamber 12 is threaded to mate to the bottom of water compartment 14, and an O-ring 20 provides a temporary leak-tight seal between the two. The bottom of the formula chamber 12 is sealed with a movable inverted piston 22 with O-rings 26 forming a leak-tight seal with the inside of the chamber 12. The top of the chamber 12 is normally closed with a full inside diameter lid 30 sealed with O-ring 32. The lid 30 is optionally tethered to the chamber 12 with a hinge or string 34. As another option to the tether, the lid can be attached to the pushrod, which would then be removably attached to the body of the piston for thorough cleaning. While O-ring seals are preferred presently, other types may work as well or become preferred in the future.

Figure 2:
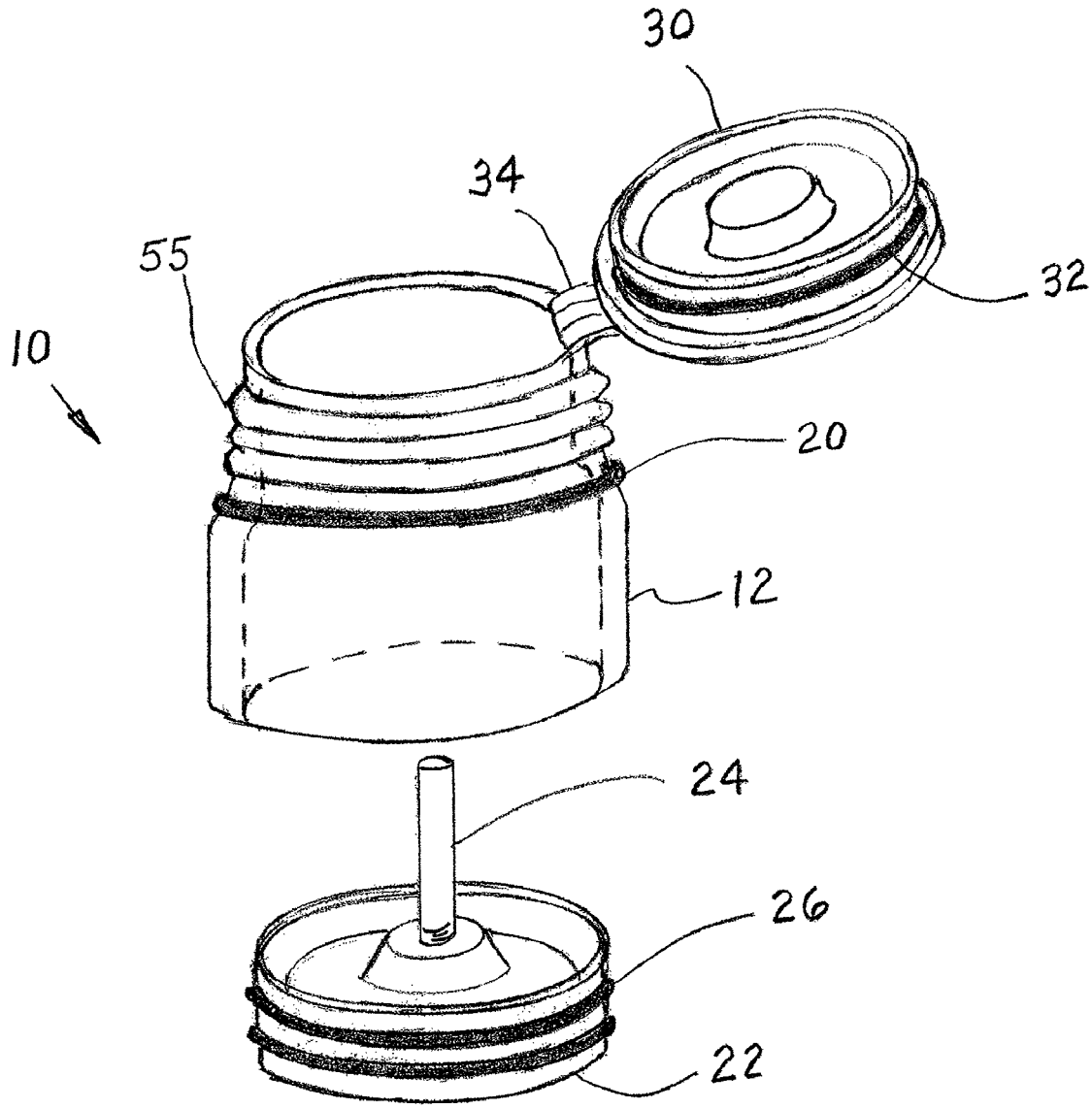
FIG. 2 is a perspective exploded view of the upper two main parts of the invention.

FIG. 2 provides an exploded perspective view of the main parts of the novel apparatus 10 for storage and delivery of powdered baby formula. The powder chamber body 12 has bottle-mating threads 55 for mating to a bottle positioned above holding water sealed from leaking by O-ring 20. The bottom of the chamber 12 is closed in by inverted piston 22 which seals against the inside walls with O-rings 26. A central push rod 24 extends upward from the inverted piston 22. With the bottom piston in place, powdered formula is measured and added to the chamber 12. The lid 30 is then closed and sealed against leaks by O-ring 32. An optional hinge 34 keeps the lid conveniently close to the chamber 12. In operation, the sealed formula chamber 12 is screwed onto the bottom of a matching bottle, not shown. When feeding time arrives, the inverted piston 22 is pushed up forcing the lid 30 to open and allowing the formula and water to be mixed by shaking. The prepared formula can then be fed to the baby without any fussing with measuring and pouring while in a travel situation.

Figure 3:
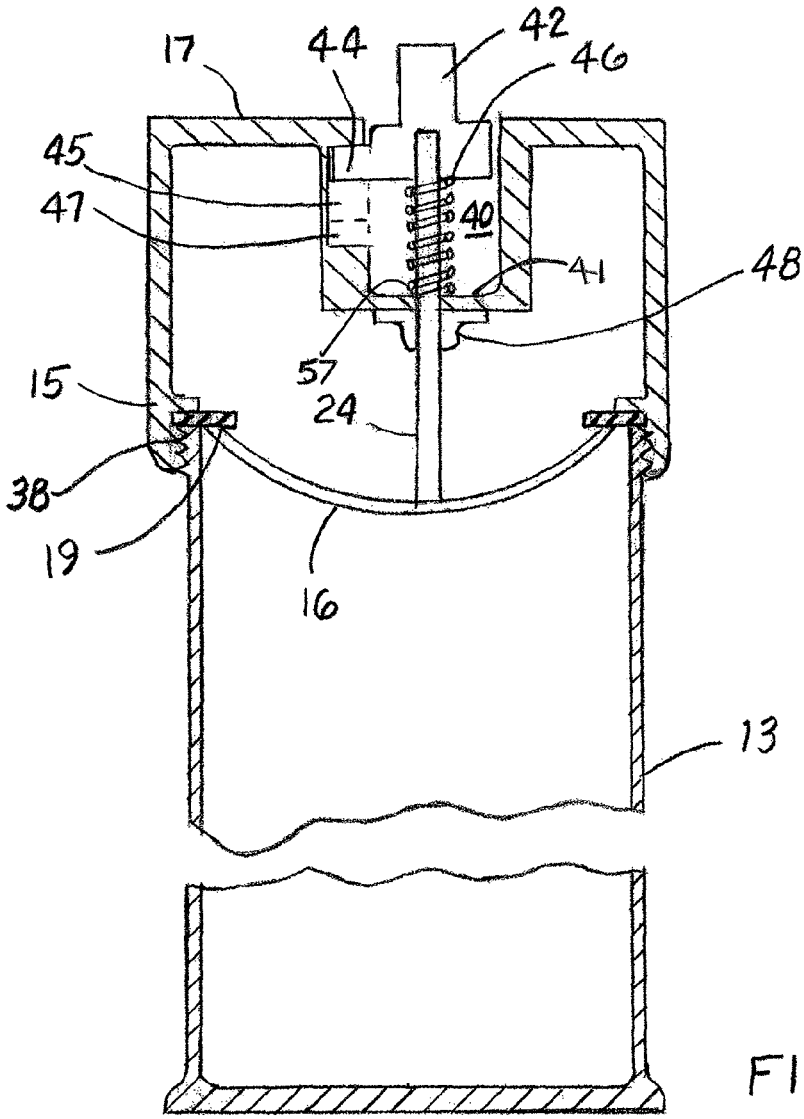
FIG. 3 is a elevation sectional view of an alternative embodiment of the invention screwed onto the top of a standard wide-mouth bottle and with the lid in the closed position.

Referring to FIG. 3, an alternative embodiment of the push-button lid release design is depicted. While this embodiment could be attached to the bottom of a bottle as with the preferred embodiment, the alternative is shown here mounted on top. An inverted cup-like chamber 15 has mating threads 38 for screwing onto a standard wide-mouth baby bottle 13, such as an Avent 9-oz Natural Feeding System. The chamber 17 seals to the bottle 13 with a wide rubber-like gasket 19. The closed end 17 of the chamber 15 has a central cavity 40 extending for about half of the depth of the chamber 15. A push rod 24 passes through a central aperture 57 at the closed end 41 of the cavity 40, then through a tight-fitting rubber bushing 48 and is fixedly attached to the compartment lid 16. The end of the pushrod 24 opposite the lid is secured to a push/turn button 42. A spring 46 encircles the pushrod 24 between the bottom of the cavity 40 and the push/turn button 42. This provides enough force to keep lid 16 normally sealed against the gasket 19. A tab 44 protrudes radially a short distance from the button 42 into a groove 45 cut partially into one part of the wall of cavity 40. At the lower end of the groove 45 is a perpendicular slot 47 that engages the tab 44 when button 42 is pushed down and turned. This action lifts the lid 16 from the gasket 19 allowing the formula powder and water to be mixed by shaking. While only one tab 44 and groove 45 are shown, it may be preferable to have two 180 degrees apart. If the compartment is on top of a bottle, the assembly must be replaced after mixing with a standard nipple assembly to allow feeding. This is not the case if it screws onto the bottom of a specially made bottle.

Figure 4:
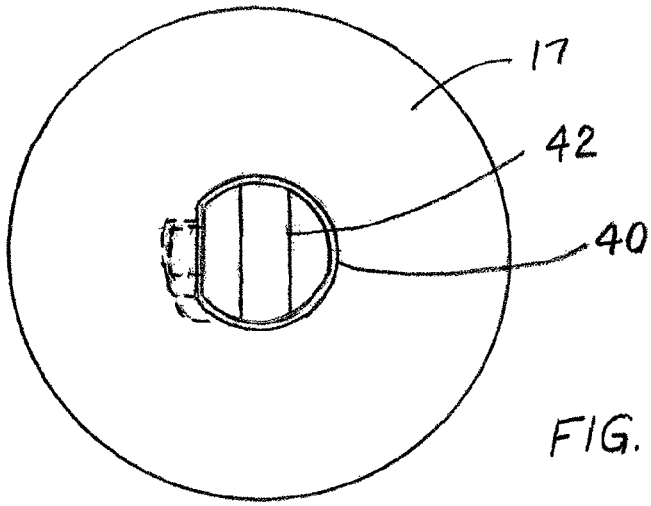
FIG. 4 is a top plan view of the alternative embodiment.

FIG. 4 provides a top plan view of the alternative embodiment. The central cavity 40 is at the center of the top surface 17. The push/turn button 42 fills most the cavity cross section and is shown with its grasp bar across the diameter.

Figure 5:
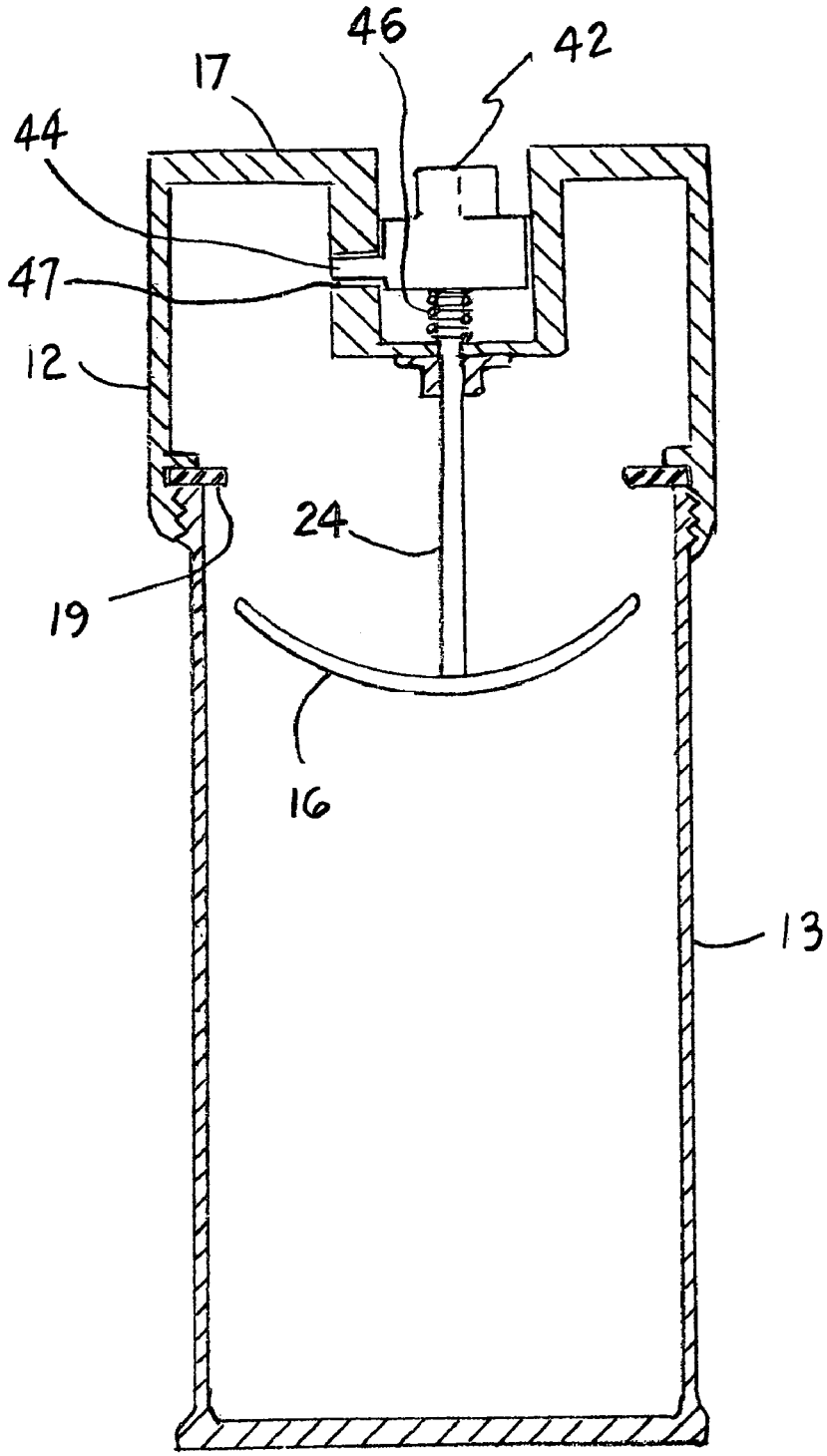
FIG. 5 is an elevation sectional view of the alternative formula apparatus with the lid in the open position.

FIG. 5 is a elevation sectional view of the second embodiment showing the lid 16 lifted off the gasket 19 with the tab 44 engaged in slot 47 thus keeping the spring compressed. As stated above, it is preferable to actually have two sets of tabs, grooves, and slots.

Figure 6:
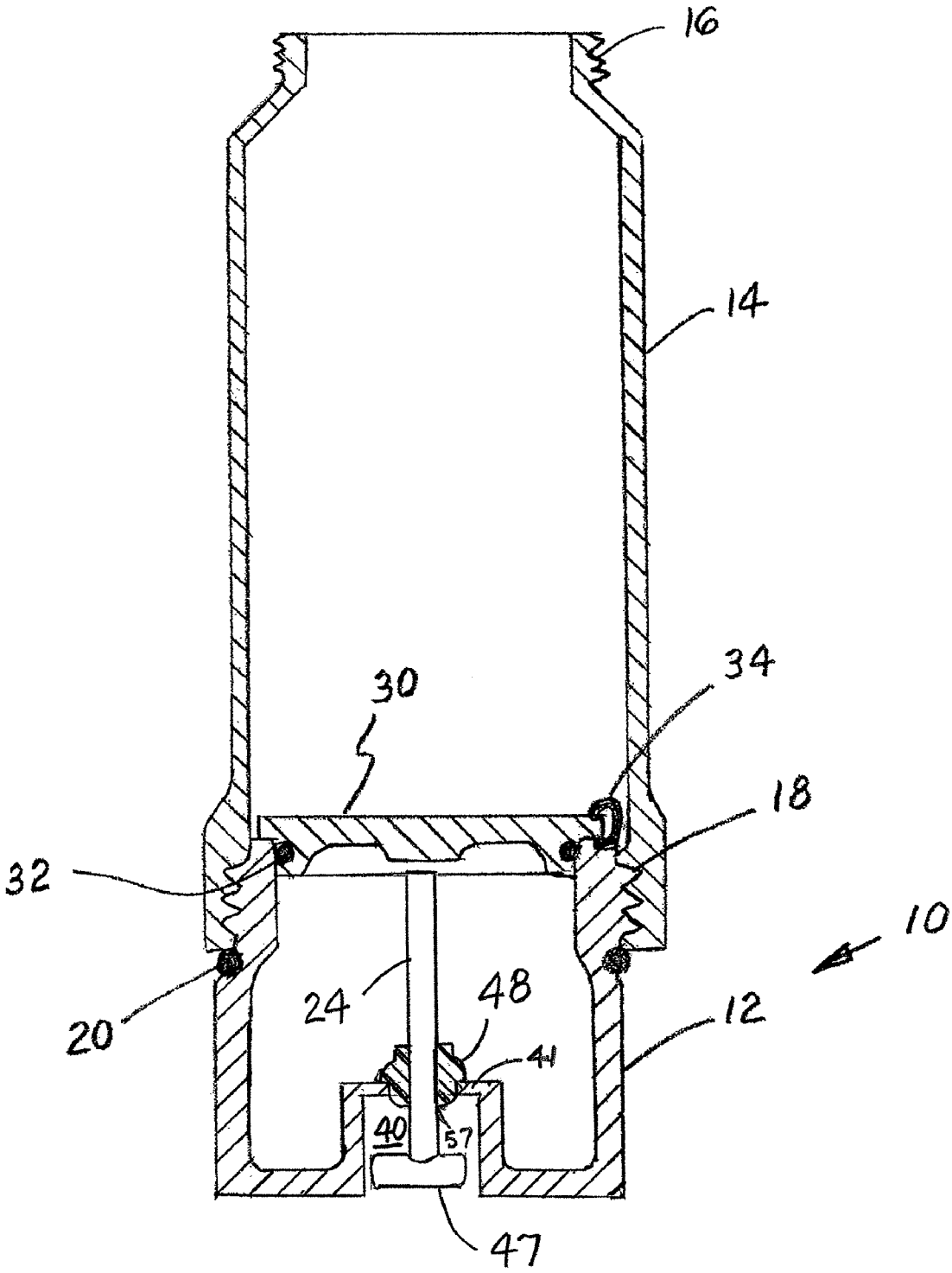
FIG. 6 is a sectional elevation of a third embodiment of the invention.

FIG. 6 provides sectional elevation view of a third embodiment of the design. A baby bottle 14 with nipple ring mating threads 16 on top, and an open bottom end with internal threads 18, screws together with a bottom powder chamber 12. They seal together with O-ring 20. A lid 30 temporarily seals shut on top of the chamber 12 with O-ring 32. The bottom of the chamber is permanently sealed shut with the exception of an orifice 57 in the closed end 41 of the cavity 40 for push rod 24 to pass through. The push rod 24 is movable, but well sealed by rubber-like bushing 48. A pushing disc 47 is attached to the outside end of the push rod 24. In operation, the chamber 12 is loaded with the appropriate amount of formula powder, then the lid 30 is sealed shut. The bottom chamber 12 then is screwed into the bottle 14 at threads 18, and the bottle is filled with the proper amount of water. The nipple assembly is then attached to threads 16. When feeding time arrives, the button pushing disc 47 is firmly pushed up thereby popping off the lid 30. The entire contents can be thoroughly blended by shaking. The baby can then be fed, all without any opening or pouring of ingredients at feeding time.

While a presently preferred and alternative embodiment of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

I claim:

1. A baby-bottle attachment comprising:

a) a cup-like chamber defining a first open end and a first closed end, said first open end having internal threads sized to mate to a threaded top on most common baby bottles, wherein said first open end has a rubber-like gasket fixedly engaged into inside circumference of said first open end;

b) a movable lid fixedly attached to an axial rod, said lid covering said first open end; and c) a central cylindrical cavity integral with said first closed end, wherein an aperture is centrally located at a second closed end of said central cylindrical cavity, wherein at least one groove extends axially along a portion of wall of said central cavity, wherein said at least one groove extending axially ends at a slot perpendicular to said groove;

d) a spring-loaded depressible button assembly positioned in said central cylindrical cavity and secured to an end of said axial rod opposite said movable lid, wherein movable portion of said button assembly has at least one tab extending radially at distal end and engageable with said at least one groove and slot; and e) a rubber-like bushing seal secured to interior of said cup-like chamber and surrounding said axial rod.

2. The baby-bottle attachment, according to claim 1, wherein said cup like chamber further includes external bottle mating threads.

* * * * *